US007053844B2

(12) United States Patent
Gaucher et al.

(10) Patent No.: US 7,053,844 B2
(45) Date of Patent: May 30, 2006

(54) INTEGRATED MULTIBAND ANTENNAS FOR COMPUTING DEVICES

(75) Inventors: Brian Paul Gaucher, Yorktown Heights, NY (US); Peter Lee, Chapel Hill, NC (US); Duixian Liu, Yorktown Heights, NY (US); Changyu Wu, Wappingers Falls, NY (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 10/794,552

(22) Filed: Mar. 5, 2004

(65) Prior Publication Data

US 2005/0195119 A1 Sep. 8, 2005

(51) Int. Cl.
*H01Q 1/24* (2006.01)

(52) U.S. Cl. ..... 343/702; 343/818; 343/700 MS

(58) Field of Classification Search ..... 343/795, 343/700 MS, 702, 725, 818, 819, 846
See application file for complete search history.

(56) References Cited

U.S. PATENT DOCUMENTS

| | | | | |
|---|---|---|---|---|
| 4,812,855 | A * | 3/1989 | Coe et al. | 343/818 |
| 5,489,914 | A * | 2/1996 | Breed | 343/818 |
| 6,011,519 | A | 1/2000 | Sadler et al. | 343/742 |
| 6,025,811 | A * | 2/2000 | Canora et al. | 343/793 |
| 6,339,400 | B1 | 1/2002 | Flint et al. | 343/702 |
| 6,456,250 | B1 * | 9/2002 | Ying et al. | 343/702 |
| 6,600,450 | B1 | 7/2003 | Efanov et al. | 343/726 |
| 6,650,294 | B1 * | 11/2003 | Ying et al. | 343/700 MS |
| 6,791,506 | B1 * | 9/2004 | Suganthan et al. | 343/795 |
| 6,894,647 | B1 * | 5/2005 | Jenwatanavet | 343/700 MS |
| 6,956,530 | B1 * | 10/2005 | Kadambi et al. | 343/702 |
| 2001/0002823 | A1 * | 6/2001 | Ying | 343/700 MS |
| 2002/0084937 | A1 | 7/2002 | Shinichi | 343/702 |
| 2002/0126047 | A1 * | 9/2002 | Laureanti | 343/700 MS |
| 2004/0108957 | A1 * | 6/2004 | Umehara et al. | 343/700 MS |
| 2004/0140941 | A1 * | 7/2004 | Joy et al. | 343/795 |

FOREIGN PATENT DOCUMENTS

WO WO 02/078123 A1 10/2002

OTHER PUBLICATIONS

Copy of U.S. Appl. No. 09/876,557, filed Jun. 7, 2001, entitled "Display Device, Computer Terminal and Antenna".
Copy of U.S. Appl. No. 09/866,974, filed May 29, 2001, entitled "An Integrated Antenna for Laptop Applications" (U.S. Appl. No. 6/686,886, issued Feb. 3, 2004).

(Continued)

*Primary Examiner*—Hoang V. Nguyen
(74) *Attorney, Agent, or Firm*—F. Chau & Associates LLC; Frank V. DeRosa

(57) ABSTRACT

Multiband antennas are provided that can be embedded in computing devices such as portable laptop computers and cellular phones, for example, to provide efficient wireless communication in multiple frequency bands. For example, monopole multiband antennas, dipole multiband antennas, and inverted-F antennas are provided, which include one or more coupled and/or branch radiating elements, for providing multiband operation in two or more frequency bands.

37 Claims, 13 Drawing Sheets

OTHER PUBLICATIONS

Copy of U.S. Appl. No. 10/370,976, filed Feb. 20, 2003, entitled "An Intergrated Dual-Band Antenna for Laptop Applications".

Copy of U.S. Appl. No. 10/318,816, filed Dec. 13, 2002, entitled "An Integrated Tri-band Antenna for Laptop Applications".

* cited by examiner

INTEGRATED MULTIBAND ANTENNAS FOR COMPUTING DEVICES

TECHNICAL FIELD OF THE INVENTION

The present invention relates generally to integrated multiband antennas for computing devices used in wireless applications. More specifically, the invention relates to multiband antennas that can be embedded in computing devices such as portable laptop computers and cellular phones, for example, to provide efficient wireless communication in multiple frequency bands.

BACKGROUND

To provide wireless connectivity between a computing device (e.g., portable laptop computer) and other computing devices (laptops, servers, etc.), peripherals (e.g., printers, mouse, keyboard, etc.) or communication devices (modem, smart phones, etc.), it is necessary to equip such devices with antennas. For example, with portable laptop computers, an antenna may be located either external to the device or integrated (embedded) within the device (e.g., embedded in the display unit).

For example, FIG. 1 is a diagram illustrating various conventional embodiments for providing external antennas for a laptop computer. A monopole antenna (10) can be located at the top of a display unit of the laptop computer. Alternatively, an antenna (11) can be located on a PC card (12). The laptop computer will provide optimum wireless connection performance with the antenna (10) mounted on the top of the display due to the very good RF (radio frequency) clearance. There are disadvantages associated with laptop designs having external antennas, however, such as high manufacture costs, possible reduction of the strength of the antenna (e.g., for the PC card antenna 12), susceptibility to damage, and the effects on the appearance of the laptop due to the antenna.

Other conventional laptop antenna designs include embedded designs wherein one or more antennas are integrally built (embedded antenna) within a laptop. For example, FIG. 2 illustrates conventional embedded antenna implementations, wherein one or more antennas (20, 21, 22) (e.g., whip-like or slot embedded antennas) are embedded in a laptop display. In one conventional embodiment, two embedded antennas (20, 21) are placed on the left and right edges of the display. The use of two antennas (as opposed to one antenna) will reduce the blockage caused by the display in some directions and provide space diversity to the wireless communication system. In another conventional configuration, one antenna (20 or 21) is disposed on one side of the display and a second antenna (22) is disposed in an upper portion of the display. This conventional antenna configuration may also provide antenna polarization diversity depending on the antenna design used.

Although embedded antenna designs can overcome some of the above-mentioned disadvantages associated with external antenna designs (e.g., less susceptible to damage), embedded antenna designs typically do not perform as well as external antennas. One conventional method to improve the performance of an embedded antenna is to dispose the antenna at a certain distance from any metal component of a laptop. For example, depending on the laptop design and the antenna type used, the distance between the antenna and any metal component should be at least 10 mm. Another disadvantage associated with embedded antenna designs is that the size of the laptop must be increased to accommodate antenna placement, especially when two or more antennas are used (as shown in FIG. 2).

Continuing advances in wireless communications technology has lead to significant interest in development and implementation of wireless computer applications. For example, the 2.4 GHz ISM band is widely used in wireless network connectivity. In particular, many laptop computers will incorporate the known Bluetooth technology as a cable replacement between portable and/or fixed electronic devices and IEEE 802.11b technology for WLAN (wireless local area network). If an 802.11b device is used, the 2.4 GHz band can provide a data rate up to 11 Mbps. To provide even higher data rates and provide compatibility with worldwide wireless communication applications and environments, 802.11a wireless devices that operate in the 5 GHz band in the 5.15–5.85 GHz frequency range can provide data rates up to 54 Mbps. Further, 802.11g devices operating in the 2.4 GHz band can also reach a data rate of 54 Mbps. However, 802.11a devices with proposed channel binding techniques will extend the data rate to 108 Mbps. Moreover, newer WLAN devices have been developed which combine a/b/g. Accordingly, the demand for multiband antennas that are designed for efficient operation in multiple frequency bands (e.g., the 2.4 and 5 GHz bands) is increasing.

SUMMARY OF THE INVENTION

Exemplary embodiment of the invention generally include integrated multiband antennas for computing devices used in wireless applications. More specifically, exemplary embodiments of the invention include multiband antennas that can be embedded in computing devices such as portable laptop computers and cellular phones, for example, to provide efficient wireless communication in multiple frequency bands.

Various exemplary embodiments of integrated multiband antennas according to the invention generally include monopole multiband antenna frameworks and dipole multiband antenna frameworks having one or more coupled and/or branch radiating elements for providing multiband operation in two or more frequency bands. Further, exemplary embodiments of the invention include inverted-F (INF) multiband antenna frameworks having one or more coupled and/or branch radiating elements for providing multiband operation in two or more frequency bands.

More specifically, in one exemplary embodiment of the invention, a multiband antenna comprises a dipole radiator, one or more coupled radiators, and one or more branch radiators connected to the dipole radiator.

In another exemplary embodiment of the invention, a multiband antenna comprises a monopole radiator, one or more coupled radiators, and one or more branch radiators connected to the monopole radiator. The multiband antenna is fed with a single feed connected to the monopole radiator.

In another exemplary embodiment of the invention, a multiband antenna comprises an inverted-F radiator, one or more coupled radiators, and one or more branch radiators connected to the inverted-F radiator. The multiband antenna is fed with a single feed connected to the inverted-F radiator. One of the coupled radiator may be an inverted-L radiator. One or more of the branch radiators may be connected to the inverted-F radiator at a feed tab of the inverted-F radiator.

In another exemplary embodiment of the invention, a multiband antenna comprises a monopole radiator, and one or more branch radiators connected to the monopole radiator. The monopole radiator may be bent to form of an inverted-F radiator. The inverted-F radiator may comprise a feed tab, and one or more of the branch radiators may be attached to the inverted-F radiator at a point on the feed tab.

These and other exemplary embodiments, objects, embodiments, features and advantages of the present invention will be described or become apparent from the following detailed description of preferred embodiments, which is to be read in connection with the accompanying drawings.

DETAILED DESCRIPTION OF EXEMPLARY EMBODIMENTS

Figure 1:
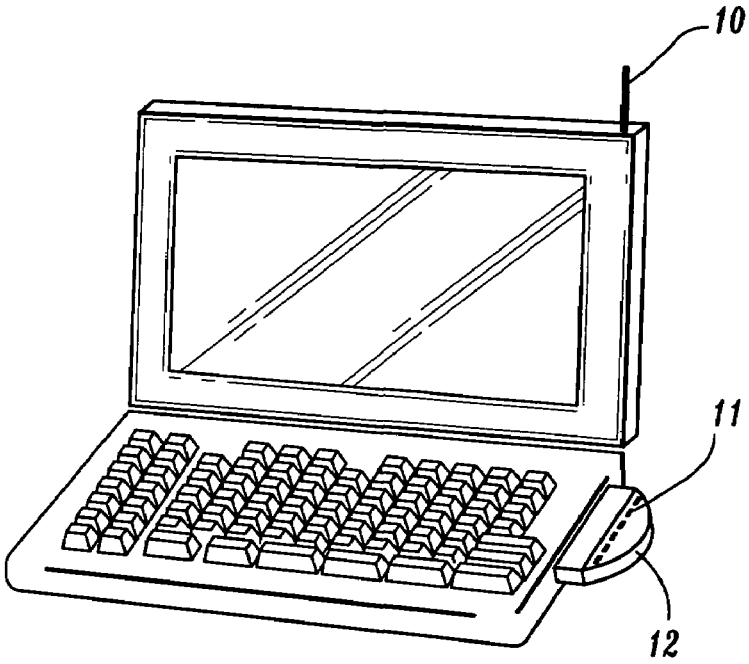
FIG. 1 (Prior Art)
FIG. 1 is a diagram illustrating various conventional embodiments of external antennas for a laptop computer.

In general, exemplary embodiments of the invention described herein include integrated multiband antenna designs for use with computing devices (e.g., laptop computers, cellular phones, PDAs, etc.) for wireless applications. For example, various exemplary embodiments of integrated multiband antennas according to the invention generally include monopole multiband antenna frameworks and dipole multiband antenna frameworks having one or more coupled and/or branch radiating elements for providing multiband operation in two or more frequency bands. Further, exemplary embodiments of the invention include inverted-F (INF) multiband antenna frameworks having one or more coupled and/or branch radiating elements for providing multiband operation in two or more frequency bands.

Exemplary multiband antenna frameworks according to the invention provide flexible and low cost designs that can be implemented for a variety of wireless applications. For example, multiband antennas according to the invention can be used for WLAN (Wireless Local Area Network) applications for providing tri-band operation in the 2.4–2.5 GHz, 4.9–5.35 GHz and 5.47–5.85 GHz frequency ranges. Moreover, exemplary antenna frameworks according to the invention can be implemented for dual-band, tri-band or quad-band operation for cellular applications (e.g., 824–894 MHz AMPS or Digital Cellular, 880–960 MHz GSM, 1710–1880 MHz DC1800, and/or 1850–1990 MHz PCS). In accordance with the invention, multiband antennas with one feed provide advantages, such as saving very expensive RF connectors and coaxial cables, over multi-feed antennas for cellular and WLAN applications.

Recently, novel embedded antenna designs have been proposed which enable computing devices, such as laptop computers, to provide multiband operation in the 2.4–2.5 GHz, 5.15–5.35 GHz and/or 5.47–5.85 GHz bands, for example, and which provide significant improvements over conventional embedded antenna designs. For example, U.S. Pat. No. 6,339,400, issued to Flint et al. on Jan. 15, 2002, entitled "Integrated Antenna For Laptop Applications", and U.S. patent application Ser. No. 09/876,557, filed on Jun. 7, 2001, entitled "Display Device, Computer Terminal and Antenna," which are commonly assigned and incorporated herein by reference, disclose various embedded single-band antenna designs for laptop computers, which may be implemented to operate in the 2.4 GHz ISM band frequency band, for example.

Furthermore, U.S. patent application Ser. No. 09/866,974, filed on May 29, 2001, entitled "An Integrated Antenna for Laptop Applications", and U.S. patent application Ser. No. 10/370,976, filed on Feb. 20, 2003, entitled "An integrated Dual-Band Antenna for Laptop Applications," both of which are commonly assigned and incorporated herein by reference, describe embedded dual-band antennas for laptop computers that can operate in the 2.4 GHz ISM band and 5.15–5.35 GHz bands, for example. In addition, U.S. patent application Ser. No. 10/318,816, filed on Dec. 13, 2002, entitled "An Integrated Tri-Band Antenna for Laptop Applications", which is commonly assigned and incorporated herein by reference, discloses various embedded tri-band antennas for laptop computers that can operate in the 2.4–2.5 GHz, 5.15–5.35 GHz and 5.47–5.85 GHz bands, for example.

The above incorporated patents and patent applications describe various embedded (integrated) antennas that can be used, for example, with portable computers, wherein the antennas are mounted on a metallic support frame or rim of a display device (e.g., LCD panel), or other internal metal support structure, as well as antennas that can be integrally formed on RF shielding foil that is located on the back of the display unit. For example, antennas can be designed by patterning one or more antenna elements on a PCB, and then connecting the patterned PCB to the metal support frame of the display panel, wherein the metal frame of the display unit is used as a ground plane for the antennas. A coaxial transmission line can be used to feed an embedded antenna, wherein the center conductor is coupled to a radiating element of the antenna and the outer (ground connector) is coupled to the metal rim of the display unit. Advantageously, these embedded (integrated) antenna designs support many antenna types, such as slot antennas, inverted-F antennas and notch antennas, and provide many advantages such as smaller antenna size, low manufacturing costs, compatibility with standard industrial laptop/display architectures, and reliable performance.

Figure 2:
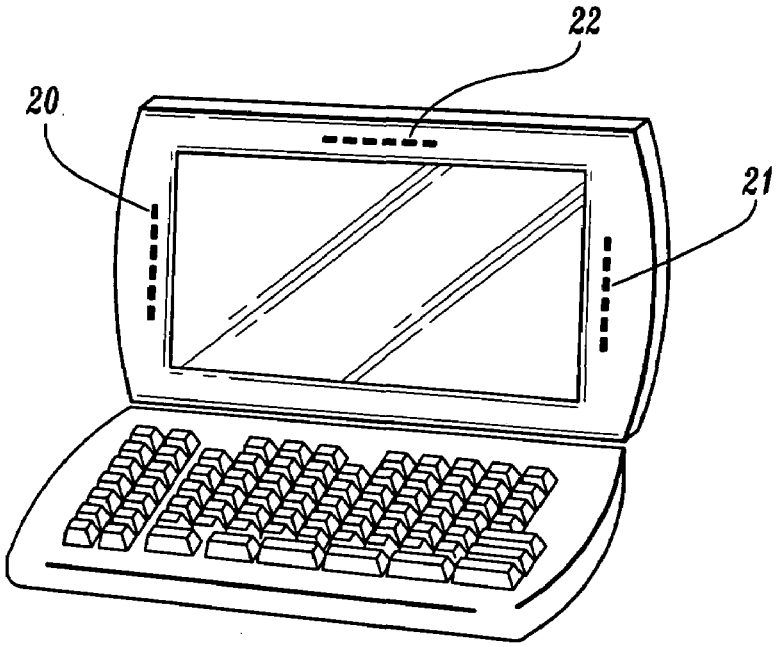
FIG. 2 (Prior Art)
FIG. 2 is a diagram illustrating various conventional embodiments of embedded (integrated) antennas for a laptop computer.
Figure 3:
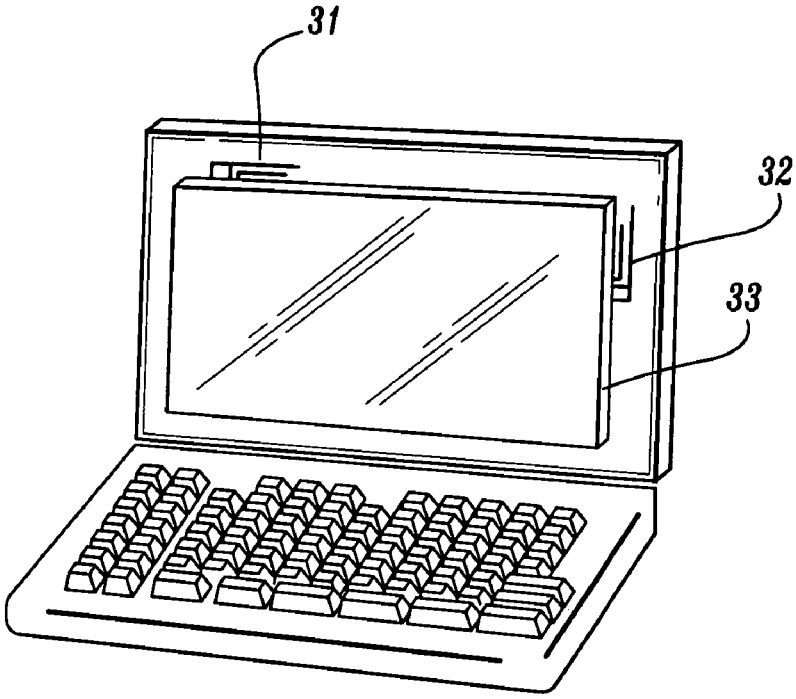
FIGS. 3 and 4 are schematic diagrams illustrating novel methods for mounting embedded antennas on a laptop display unit.
Figure 4:
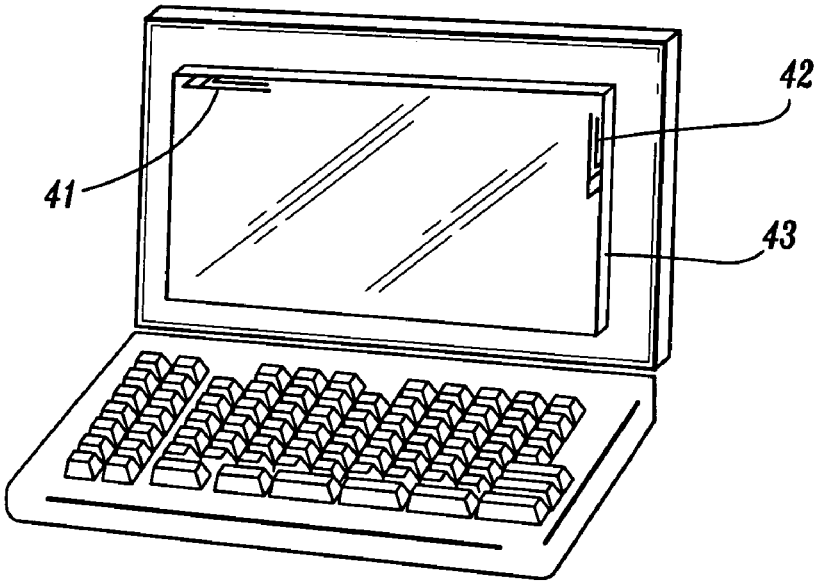

FIGS. 3 and 4 are schematic diagrams illustrating various orientations for mounting integrated antennas on a laptop display unit, such as disclosed in the above incorporated patents and applications, as well as multiband antenna frameworks in accordance with the present invention. For example, FIG. 3 schematically illustrates a pair of multiband antennas (31, 32) that are mounted to a metal support frame (33) of a laptop display unit (or a metal rim of an LCD), wherein a plane of each multiband antenna (31, 32) is substantially parallel to the plane (or along the plane) of the support frame (33). FIG. 4 illustrates a pair of multiband antennas (41, 42) that are mounted to a metal support frame (43) of the laptop display unit, wherein a plane of each of the multiband antennas (41, 42) is disposed substantially perpendicular to a plane of support frame (43). FIG. 4 shows the integrated antennas perpendicular to the LCD. The antennas are mounted on metal rim of LCD or on the metal support structure of the display. In most laptop display design, this is a space saving implementation. Advantageously, with respect to laptop computers, for example, the embedded antenna designs of the above-incorporated patents and applications provide a space saving implementation, whereby the display cover of the display unit does not have to be larger than necessary to accommodate these antennas (which is to be contrasted with the conventional embedded designs as illustrated in FIG. 2).

Figure 5:
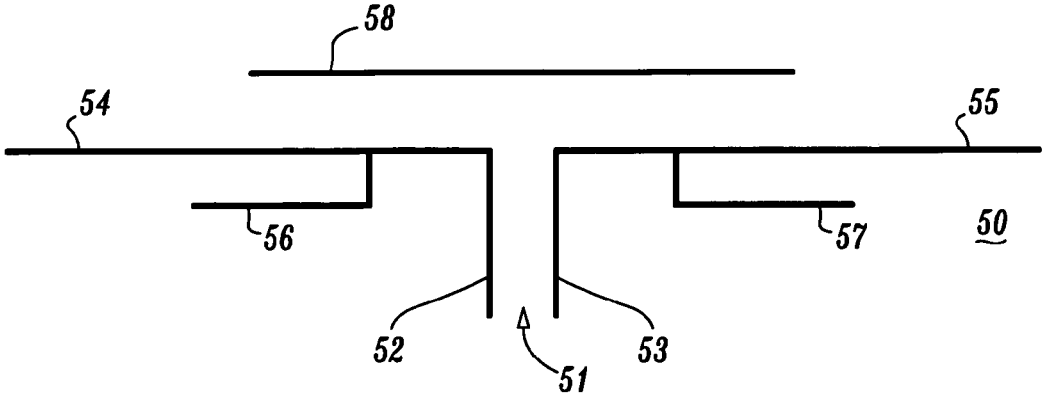
FIG. 5 schematically illustrates a dipole multiband antenna having coupled and branch radiating elements, according to an exemplary embodiment of the invention.
Figure 6:
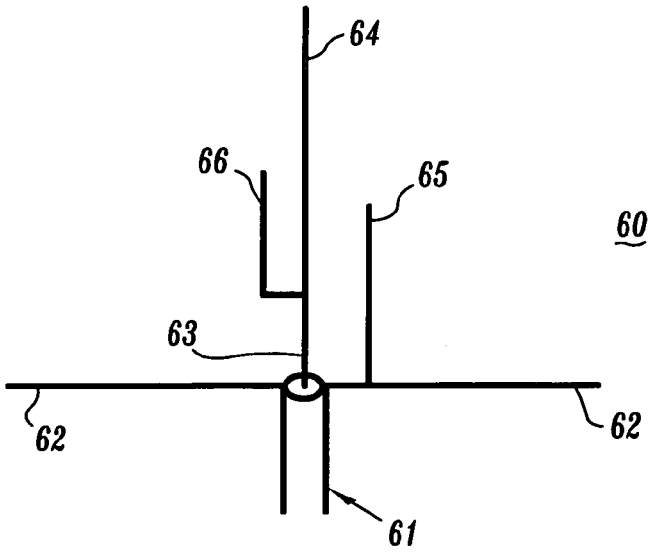
FIG. 6 schematically illustrates a monopole multiband antenna having coupled and branch radiating elements, according to an exemplary embodiment of the invention.

Exemplary embodiments of integrated multiband antenna frameworks according to the present invention include extensions of the dual-band and tri-band integrated antenna designs described in the above-incorporated patent applications and patents. FIGS. 5, 6 and 7A~7I are diagrams that schematically illustrate multiband antenna frameworks according to exemplary embodiments of the present invention. In general, FIG. 5 schematically illustrates an exemplary dipole multiband antenna (50) having coupled and branch radiating elements, FIG. 6 schematically illustrates an exemplary monopole multiband antenna (60) having coupled and branch radiating elements, and FIGS. 7A~7I schematically illustrate various exemplary inverted-F multiband antennas that include both coupled and branch elements, for providing multiband operation.

More specifically, FIG. 5 schematically illustrates a multiband dipole antenna (50) according to an exemplary embodiment of the invention, wherein the multiband dipole antenna (50) is fed using a balanced transmission line (51) with lines (52) and (53). The multiband dipole antenna (50) comprises radiating elements (54) and (55), which provide dipole operation in a first frequency band (having the lowest resonant frequency). In addition, the dipole multiband antenna (50) comprises a coupled radiating element (58) and branch radiating elements (56) and (57). The exemplary multiband dipole antenna (50) can provide dual-band or tri-band operation and can be implemented for applications that require a balanced feed or which do not require a ground plane (i.e., ground plane independent).

FIG. 6 schematically illustrates a multiband monopole antenna (60) according to an exemplary embodiment of the invention, which is fed using a single feed structure, such as a coaxial cable (61), and which implements a ground plane (62). The multiband monopole antenna (60) comprises a radiating element (64) which is connected to a center conductor (63) of the coaxial cable (61). In addition, the multiband monopole antenna (60) comprises a coupled radiator element (65) and a branch radiator element (66) that is connected to the radiator (feed) element (64).

In general, as compared to the multiband dipole antenna (50), the multiband monopole antenna (60) provides a savings in space of about 50%, and utilizes a single end feed that is convenient for many applications. The performances of the multiband dipole and monopole antenna structures are similar.

FIGS. 7A~7I schematically illustrate various exemplary embodiments of inverted-F (INF) multiband antennas according to the invention. As shown, each of the inverted-F (INF) multiband antennas commonly include a ground plane element (71), an inverted-F (INF) element comprised of elements (72) and (73), and an inverted-L (INL) element comprised of elements (74) and (78). The element (73) of the INF element is fed using a single coaxial cable (70) having a center conductor (75) that is connected to the element (73), and an outside shield element (77) that is connected to the ground element (71). The element (73) may comprise a feed tab (not shown) that connects to the center conductor (75). The inverted-L element (elements (74) and (78)) is a coupled radiator element that is connected to the ground element (71).

Figure 7A:
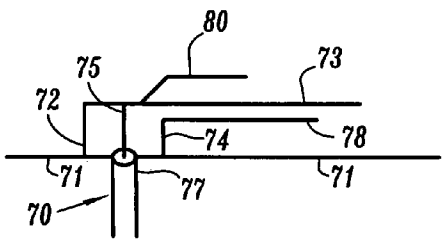
FIGS. 7A~7I schematically illustrate various inverted-F multiband antennas that include both coupled and branch elements, according to exemplary embodiments of the invention.
Figure 7B:
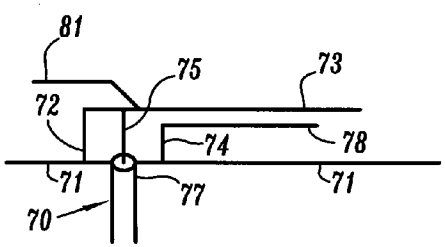
Figure 7C:
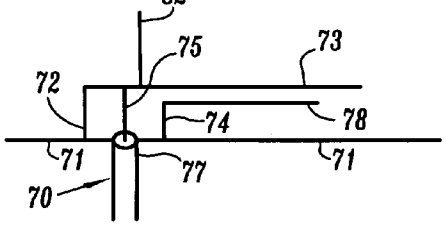
Figure 7D:
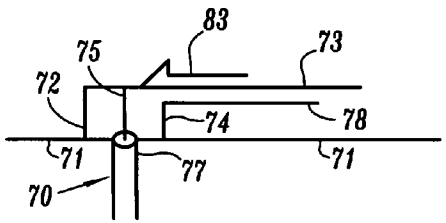
Figure 7E:
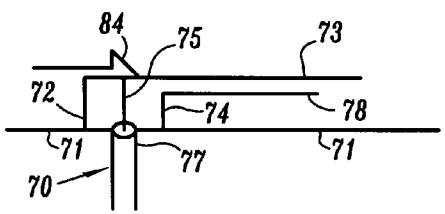
Figure 7F:
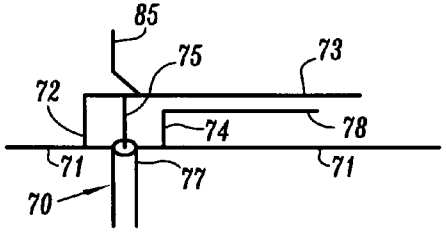
Figure 7G:
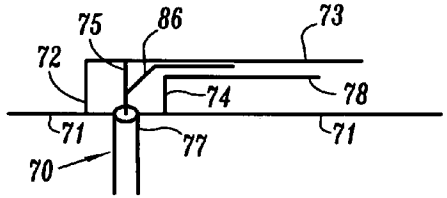
Figure 7H:
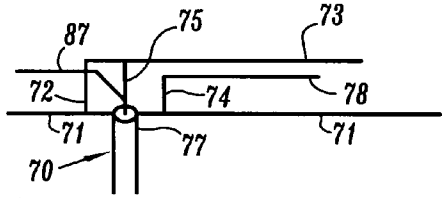
Figure 7I:
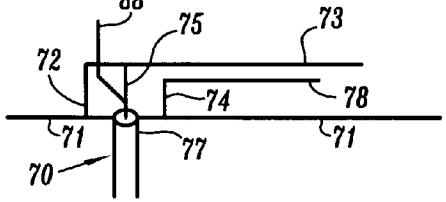

Each INF multiband antenna design depicted in FIGS. 7A~7I further includes a branch radiator element (80)~(88), respectively. FIGS. 7A~7F schematically illustrate various shapes and orientations of branch elements (80)~(85) connected to element (73) of the INF antenna element, and FIGS. 7G~7I schematically illustrate various shapes and orientations of branch elements (86)~(88) connected to the feed element (75). The INF multiband antenna frameworks depicted in FIGS. 7A~7I are merely exemplary and that other structures may be readily envisioned by one of ordinary skill in the art based on the teachings herein. For example, in other exemplary embodiments, INF multiband antennas may include branch radiator elements that are connected to element (72) of the INF element. Moreover, INF multiband antennas may include no coupled element, but rather only one or more branch elements connected to the INF element (73) and/or the INF feed element (75).

FIGS. 7A~7I illustrate the flexibility afforded by multiband antennas according to the invention. Those of ordinary skill in the art will readily appreciate that the size, shape, and/or positioning of the various antenna elements will vary depending on, for example, the type of components used to construct the antennas (e.g., wires, planar metal strips, PCBs, etc.), the antenna environment, the available space for the antenna, and the relative frequency bands when used for different applications.

Figures 8A, 8B, 8C:
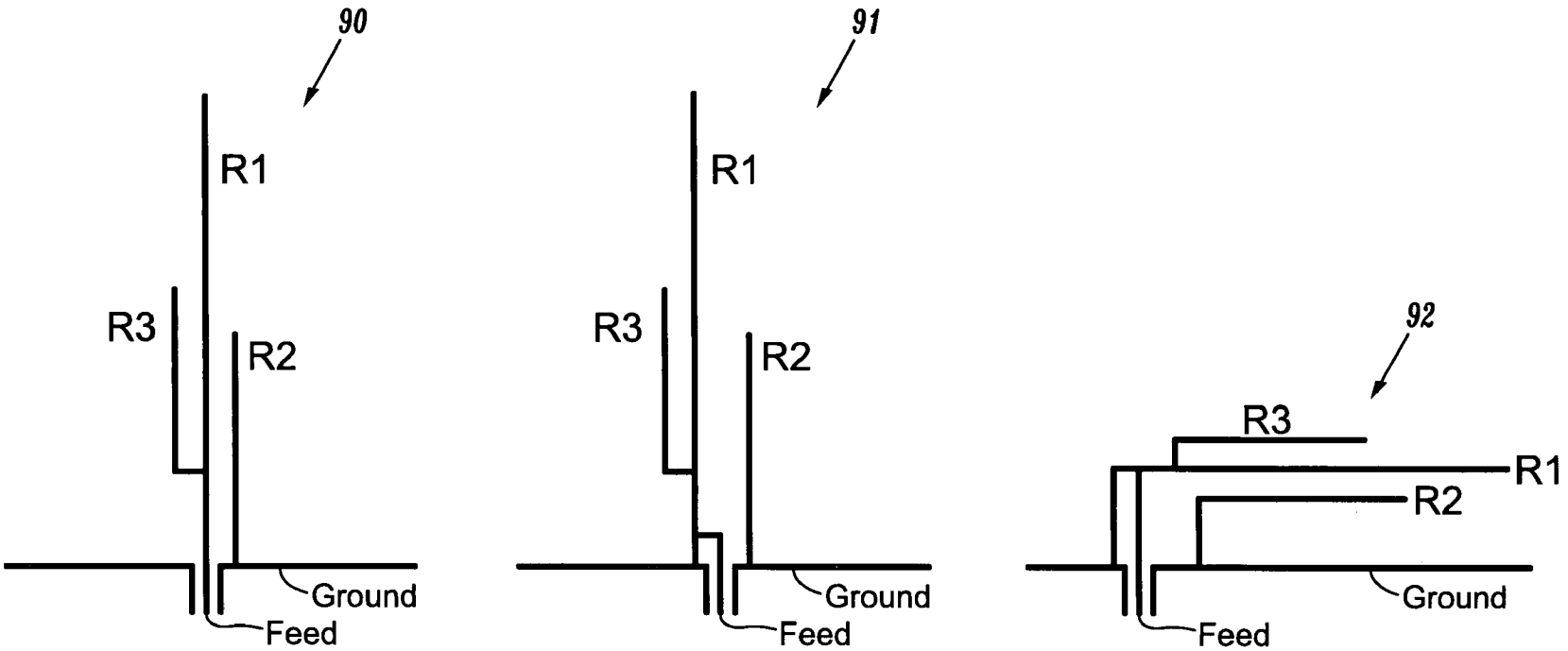
FIGS. 8A~8C are schematic illustrations of multiband antennas frameworks according to various exemplary embodiments of the invention.

FIGS. 8A~8C are schematic illustrations of multiband antennas frameworks according to various exemplary embodiments of the invention. In general, FIG. 8A depicts an exemplary monopole multiband antenna (90) having an architecture based on the monopole multiband antenna (60) in FIG. 6. FIG. 8B depicts an exemplary monopole multiband antenna (91) having an architecture similar to that depicted in FIG. 8A where the fed antenna element is grounded. FIG. 8C depicts another exemplary embodiment of an INF multiband antenna (92) according to the invention, which is based, for example, on the frameworks discussed above with respect to FIGS. 7A~7F.

More specifically FIGS. 8A~8C schematically illustrate multiband antennas (90)~(92), respectively, each comprising three radiating elements R1, R2 and R3. The multiband antennas (90)~(92) can provide tri-band operation when the radiating elements R1, R2 and R3 are designed to have different resonance frequencies in separate, discreet bands. Moreover, the multiband antennas (90)~(92) can be implemented for dual-band applications where the radiating element R1 is designed for the first (low) band, and wherein radiating elements R2 and R3, for example, are designed for providing a wide frequency span (wide bandwidth) for the second (high) band.

In each antenna (90), (91) and (92), the element R1 is connected to signal feed (e.g., center conductor of coaxial transmission line). Further, the element R1 is the longest element and resonates at a lowest frequency F1, and is approximately one-quarter wavelength in length at the frequency F1. Essentially, each multiband antenna (90~92) behaves as a quarter wavelength monopole at the low band. Further, in each multiband antenna (90), (91) and (92), the element R1 is connected to signal feed (e.g., center conductor of coaxial transmission line), but the element R1 in antenna (90) is not connected to ground, whereas the element R1 in antennas (91) and (92) are grounded.

Further, when designed to provide tri-band operation, the radiating elements R2 and R3 in the multiband antennas (90), (91) and (92) will resonate at different frequencies F2 and F3, where (F1<F2<F3) or where (F1<F3<F2). The antenna elements R2 are coupled radiating elements, which are connected to ground. In addition, the antenna elements R3 are branch elements that are connected to the radiator element R1.

FIG. 8A depicts the multiband antenna (90) as having elements R2 and R3 disposed on opposite sides of the element R1, but it is to be understood that other frameworks are possible. For example, element R2 could be disposed north of R1 such that R2-R1-R3 forms a 90 degree angle. The input impedance for the multiband antenna (90) is about 36 Ohms at the center of each band. The multiband antenna (91) of FIG. 8B is similar to the multiband antenna (90) of FIG. 8A, except that the feed antenna element R1 is grounded. The multiband antenna (91) enables improved impedance matching to 50 Ohms, which is a standard industry impedance value, depending on the connection location of the feed to element R1.

The multiband antenna (92) of FIG. 8C is similar to the multiband antenna (91) of FIG. 8B, except that the antenna elements R1, R2 and R3 are bent to reduce antenna height and provide a more compact design. It is to be noted that the branch element R3 can be bent, arranged, and/or connected in different ways to form many variations of the antenna structures as depicted in FIGS. 7A~7I. The architecture of the multiband antenna (92) is advantageously adapted for use with portable devices such as laptops due to the small, compact design of the antenna, as well as the reliability of operation.

Figure 9:
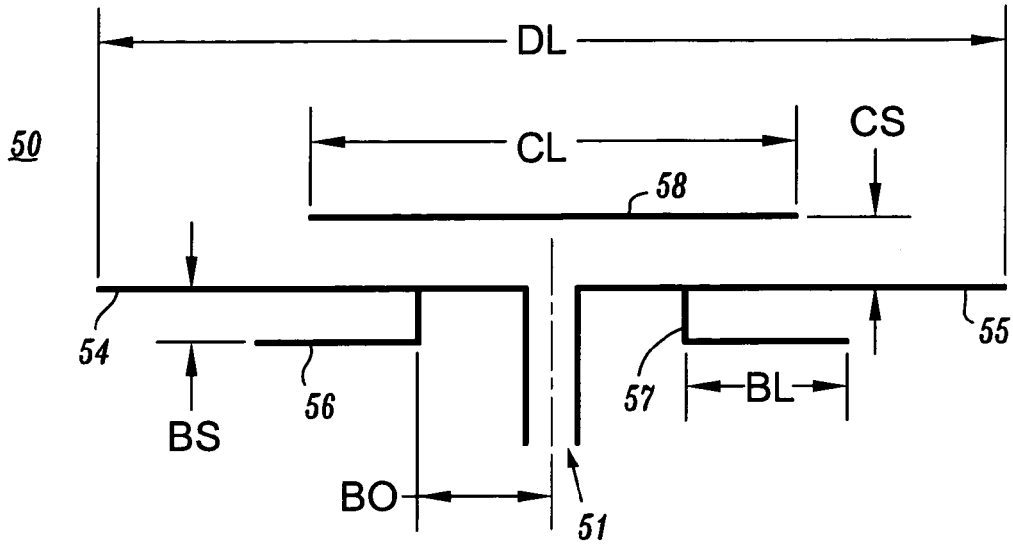
FIG. 9 illustrates various dimensions and parameters of an exemplary dipole multiband antenna, such as depicted in FIG. 5, which can be adjusted for tuning the antenna.

FIG. 9 illustrates various dimensions and parameters of the exemplary dipole multiband antenna (50) depicted in FIG. 5, which can be adjusted for tuning the antenna (50). A first (lowest) resonant frequency F1 is determined by the length (DL) of the dipole element (which includes elements (54) and (55)). In one embodiment, the dipole length (DL) is about ½ of the wavelength of F1. A second resonant frequency F2 is determined by the length (CL) of the coupled element (58). The impedance at the second resonant frequency F2 is determined by the coupling distance (CS) between the coupled element (58) and the dipole element ((55) and (54)). A third resonant frequency F3 is determined by the length (BS+BL) of the branch elements (56) and (57). Furthermore, the distance (BO) between the branch elements (56) and (57) and the center point of the balanced line (51) can be adjusted to change the impedance at the third resonant frequency F3, which also shifts F3 to some extent.

Figure 10:
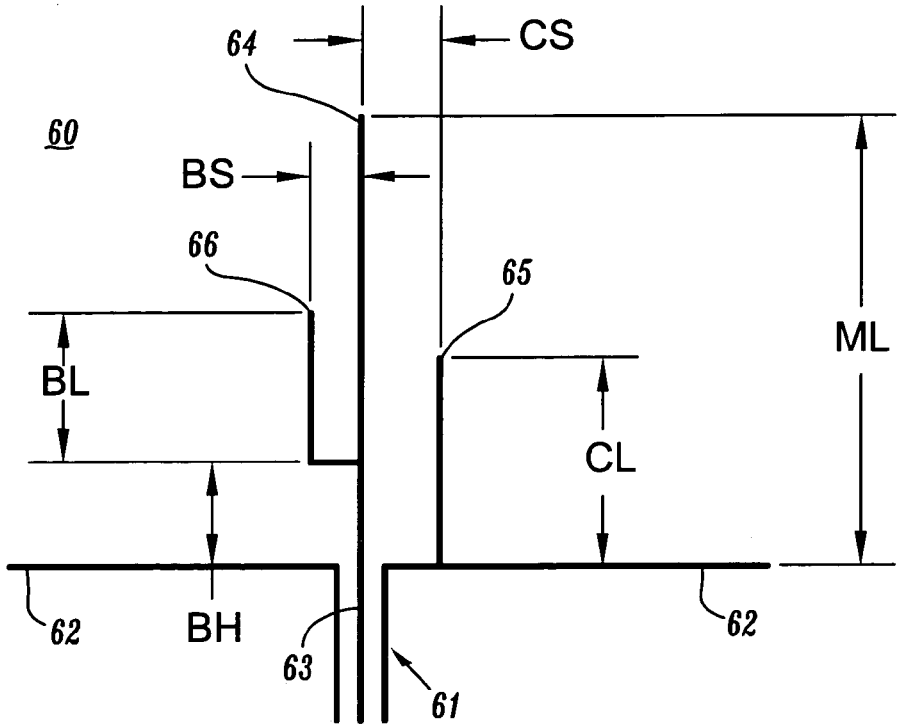
FIG. 10 illustrates various dimensions and parameters of an exemplary monopole multiband antenna, such as depicted in FIG. 6, which can be adjusted for tuning the antenna.

FIG. 10 illustrates various dimensions and parameters of the exemplary monopole multiband antenna (60) depicted in FIG. 6 (and the antenna (90) of FIG. 8A), which can be adjusted for tuning the antenna (60). A first (lowest) resonant frequency F1 is determined by the length (ML) of the monopole element (64). A second resonant frequency F2 is determined by the length (CL) of the coupled element (65). The impedance at the second resonant frequency F2 is determined by the distance (CS) between the monopole element (64) and the coupled element (65). A third resonant frequency F3 is determined by the total length (BS+BL) of the branch element (66). Further, the distance (BH) between the ground element (62) and the branch element (66) can be adjusted to change the impedance at the third resonant frequency F3, which also shifts F3 to some extent.

Figure 11:
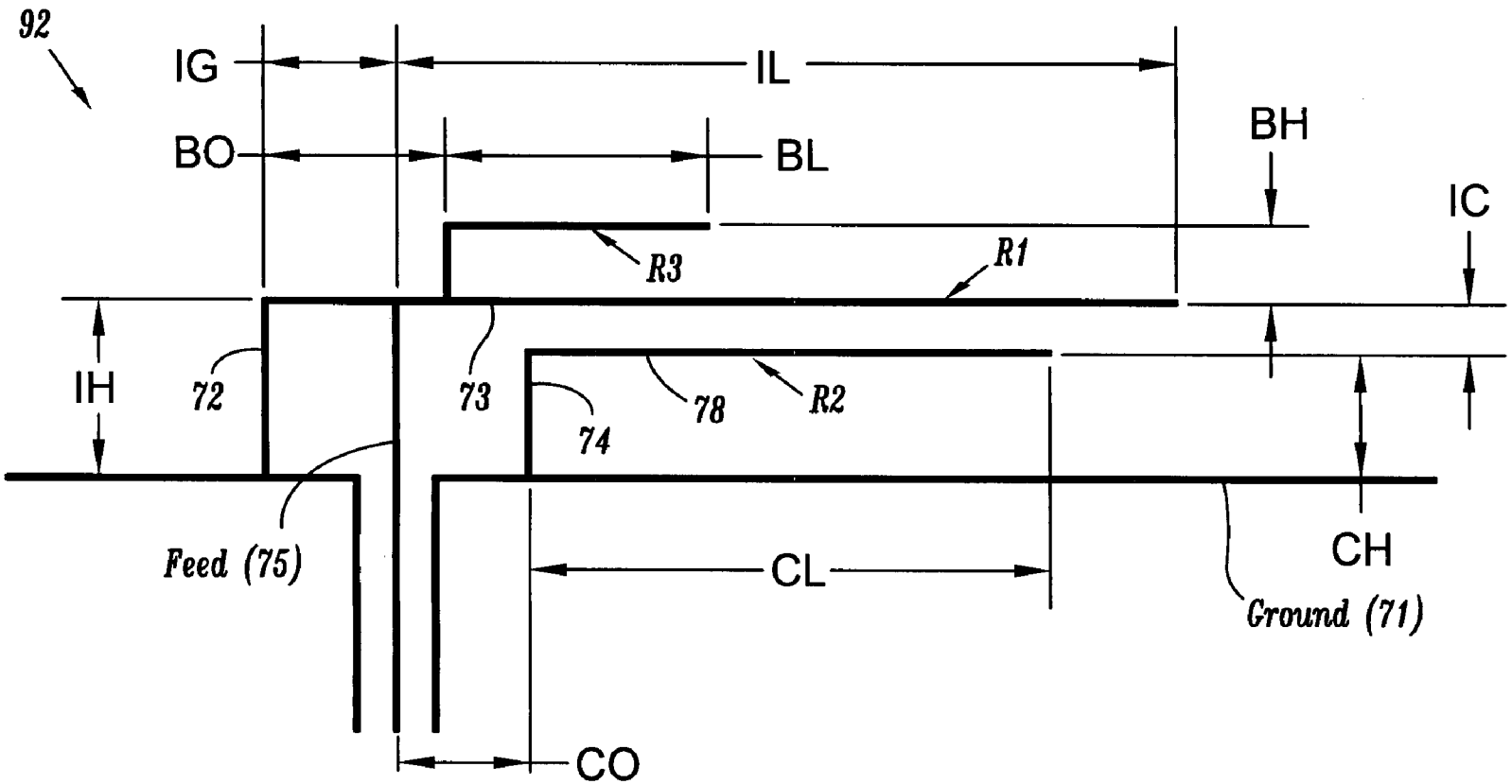
FIG. 11 illustrates various dimensions and parameters of an exemplary inverted-F multiband antenna, such as depicted in FIG. 8C, which can be adjusted for tuning the antenna.

FIG. 11 illustrates various dimensions and parameters of the exemplary INF multiband antenna (92) depicted in FIG. 8C, which can be adjusted for tuning the antenna (92). A first (lowest) resonant frequency F1 is determined primarily by the length (IH+IL) along element R1. The height (IH) can be adjusted to change the first resonant frequency F1 and the antenna bandwidth around the resonant frequency F1 (in general, increasing the height (IH) will increase the bandwidth). Further, the distance (IG) can be adjusted to change the antenna input impedance at the resonant frequency F1. Decreasing the distance (IG) will also affect the resonant frequency F1, but its effect is less significant than that of IH and IL.

Further, for the multiband antenna (92) structure, a second resonant frequency F2 is determined primarily by the total length (CH+CL) of the coupled element R2. The antenna impedance at the resonant frequency F2 is determined by the coupling (distance IC) between elements (73) of R1 and element (78) of R2, and the coupling distance (CO) between element (74) of R2 and feed element (75). The coupling will be strong if the distances (IC) or (CO) are decreased.

A the third resonant frequency F3 is determined primarily by the length (BH+BL) of the branched element R3. The connection location of the branch element R3 to element (73) of R1 determines the antenna impedance for the third resonant frequency F3, and such connection location will also have some affect the resonant frequency F3.

As described above with reference to FIGS. 7A~7I, the branch element R3 of the multiband antenna (92) in FIG. 11 may comprises various different shapes and disposed at different locations either along the elements (72) and (73) of R1 or the feed element (75). The tuning methods described above with reference to FIG. 11, for example, are essentially applicable for each of the exemplary antenna embodiments of FIGS. 7A~7F where the branch element (R3) is connected to the fed antenna element (R1), but with slightly different considerations due to, e.g., the coupling of the branch element R3.

For example, in FIG. 7C, the tuning is similar with respect to the antenna elements R1 and R2. Furthermore, the length of branch element (82) primarily determines F3. However, because the branch element (82) extends away from and is not bent towards the element (73) (as compared to element R3 in FIG. 11), there is less coupling between the branch element (82) and the element (73) of R1, which results in less impedance and a wider bandwidth around F3. FIG. 7F is similar to FIG. 7C, except that the branch element (85) is bent and orientated to reduce the antenna height and minimize the coupling of the branch element (85) to the element (73). Furthermore, the branch elements (80, 81, 83, and 84) in FIGS. 7A, 7B, 7D and 7E, respectively, have one or more bends, but the resonant frequency R3 is determined primarily by the total length of the branch elements. As compared to FIG. 7F, the orientation of the bent branch elements (80, 81, 83, and 84) can result in more coupling to the element (73) (which affects the impedance and bandwidth at the resonant frequency F3 (as well as F3 to some extent). However, the orientations of the bent branch element (81) and (84) result in less coupling as compared to orientations of the bent branch elements (80) and (83).

Furthermore, the tuning methods described above with reference to FIG. 11, for example, are applicable, for the most part, for each of the exemplary antenna embodiments of FIGS. 7G~7I where the branch elements (86), (87) and (88), respectively, are connected to the feed element (75). More specifically, the tuning is similar with respect to radiating elements R1 and R2. Moreover, the resonant frequency F3 is determined primarily by the total length of the branch elements (86), (87) and (88). However, the impedance and bandwidth at the resonant frequency F3 will vary depending on the connection location between the branch element and the feed element (75).

It is to be appreciated that depending on the application, the exemplary multiband antenna designs depicted in FIGS. 5–7 can be stamped from thin sheet metal or printed on a PCB or made of thin metal wires, and are very suitable for portable applications like laptop computers and cell phones. For laptop applications, the ground plane can be provided by the display frame, or metal supports, or the RF shielding foil on the back of the display. The antennas can be disposed parallel or perpendicular to the display as shown in FIGS. 3 and 4, respectively, depending on the industrial design requirements.

Figure 12:
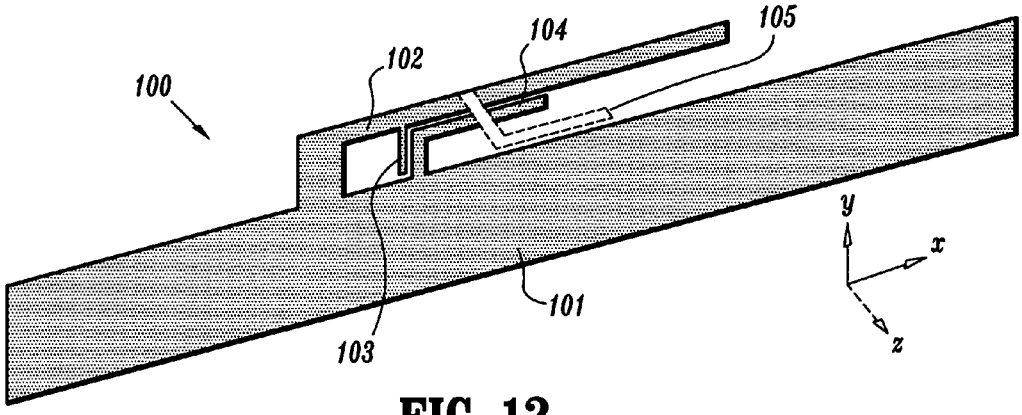
FIG. 12 schematically illustrates a perspective view of a multiband antenna according to another exemplary embodiment of the invention.

FIG. 12 schematically illustrates a perspective view of a multiband antenna (100) according to an exemplary embodiment of the invention. More specifically, FIG. 12 illustrates an INF multiband antenna (100) according to one embodiment of the invention, in which the antenna elements are formed from thin sheet metal, such as copper or brass. The INF multiband antenna (100) comprises a ground element (101), an INF element (102) connected to ground (101) and having a feed tab (103) extending therefrom, a coupled (INL) element (104) connected to ground (101), and a branch element (105) that is connected to the INF element (102). The antenna orientation in FIG. 12 shows the elements of the antenna (100) are planar (x-y plane) but that the branch element (105) positioned (in x-z plane) substantially perpendicular to the plane (x-y) of the antenna (100). The antenna (100) is fed by, e.g., a coaxial cable, wherein a center conductor is electrically connected to feed element (103) via a solder connection and wherein the outer conductor (ground) of the coaxial cable is electrically connected to the ground element (101) via a solder connection.

FIG. 12 depicts one exemplary embodiment of a multiband antenna (100) that can be formed from stamped sheet metal, wherein the antenna elements and grounding strip are stamped from a planar sheet of metal and wherein the resulting structure is then folded such that branch element (105) is folded (along a folding line connection to element (102)) to a position substantially perpendicular to the plane (x-y plane) of the antenna (100).

Figure 13:
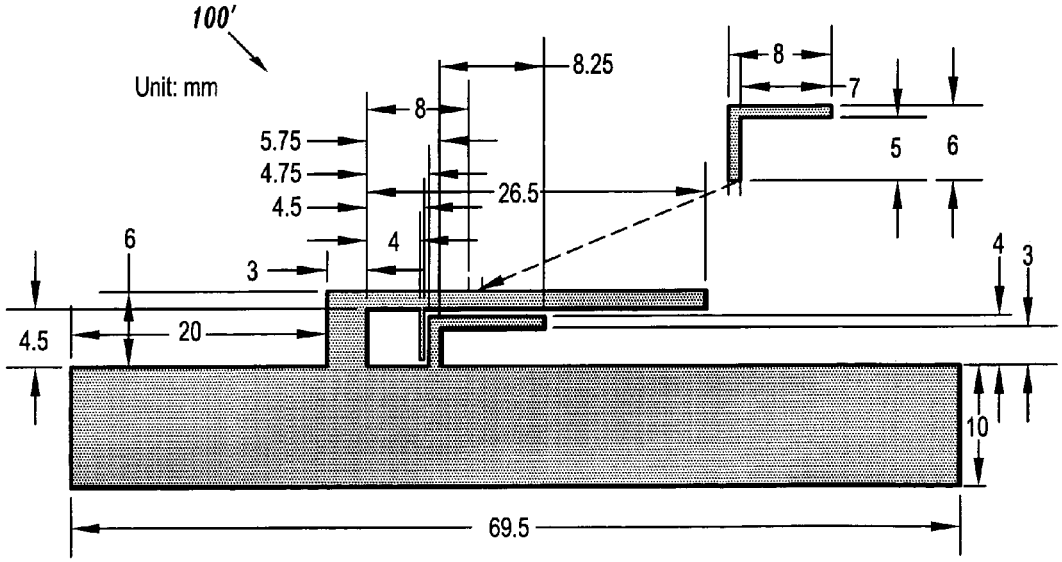
FIG. 13 schematically illustrates a multiband antenna according to another exemplary embodiment of the invention showing dimensions of the exemplary antenna embodiment of FIG. 12 to provide multiband operation in the 2.4 and 5 GHz bands.

FIG. 13 schematically illustrates a perspective view of a multiband antenna (100') according to another exemplary embodiment of the invention. More specifically, FIG. 13 depicts structural dimensions (in millimeters) for the exemplary multiband antenna (100) of FIG. 12 for dual-band operation in a first (low) frequency band (e.g., 2.4 GHz–2.5 GHZ), and a second (high) frequency band (e.g., 5.15 GHz–5.85 GHz).

Figure 14:
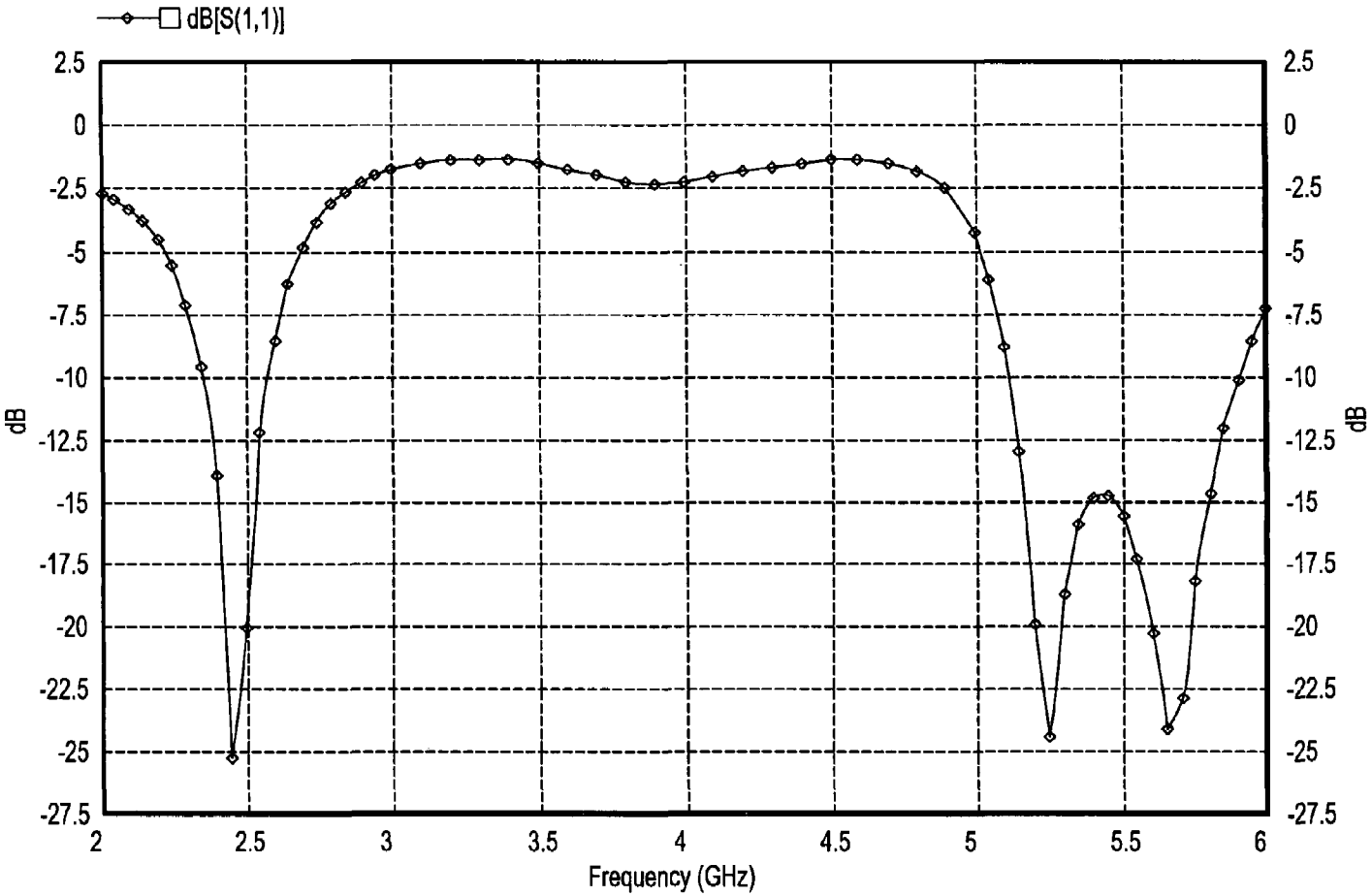
FIG. 14 is a graphical illustration of return loss that was computed based on a computer simulation of the exemplary antenna of FIG. 13.
Figure 15:
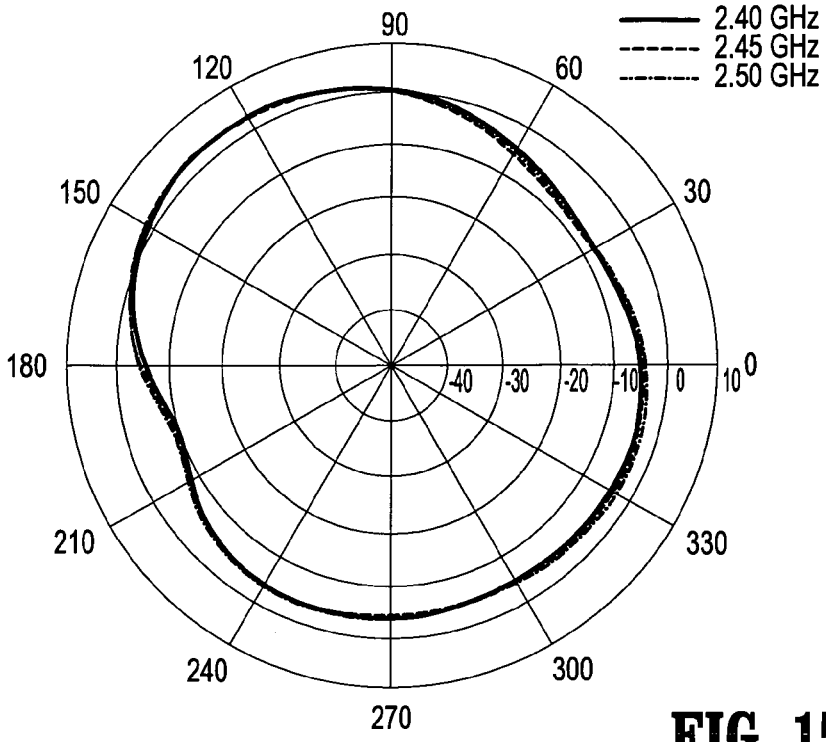
FIG. 15 is a graphical illustration of azimuth plane radiation patterns for $\theta=90°$ in the 2.4 GHz band at frequencies of 2.40, 2.45 and 2.50 GHz, based on the computer simulation of the exemplary antenna of FIG. 13.
Figure 16:
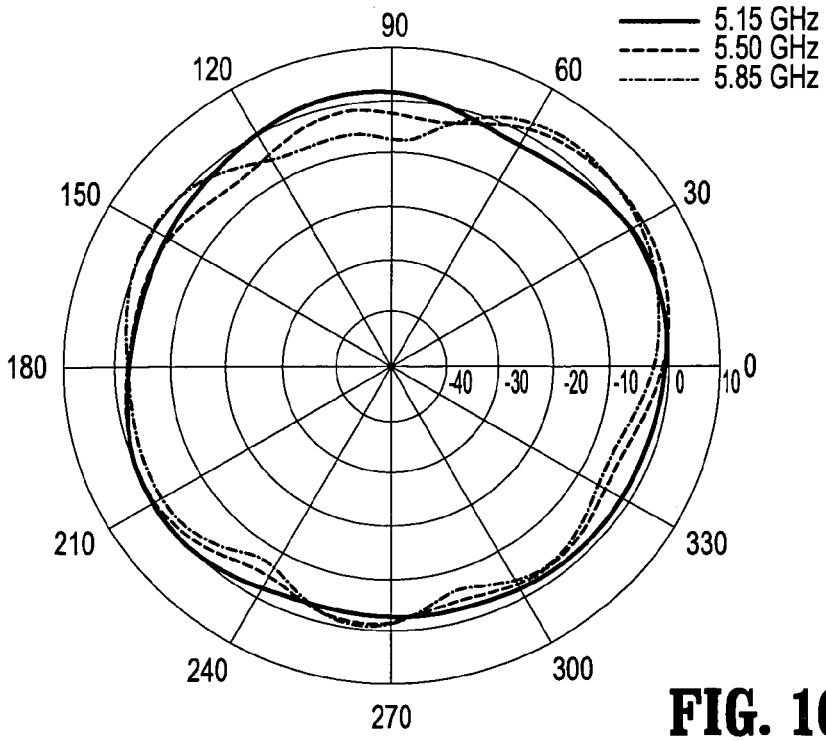
FIG. 16 is a graphical illustration of azimuth plane radiation patterns for $\theta=90°$ in the 5 GHz band at frequencies of 5.15, 5.50 and 5.85 GHz, based on the computer simulation of the exemplary antenna of FIG. 13.

FIGS. 14–16 are computer generated results that were obtained from computer simulations of an antenna model based on the antenna (100') framework (i.e., the framework and dimensions as depicted in FIGS. 12 and 13), which illustrate simulated return loss and radiation patterns for the antenna (100'). More specifically, FIG. 14 graphically illustrates the results of the simulated return loss of the multiband antenna (100') of FIG. 13. FIG. 14 graphically illustrates the simulated return loss for antenna (100') from 2~6 GHz having three resonances, where one resonance is used for the 2.4 GHz to 2.5 GHz band, and wherein two resonances are used for the 5 GHz band from 5.15 GHz to 5.85 GHz.

FIGS. 15–16 are graphical diagrams illustrating the simulated radiation patterns at different frequencies for the antenna model based on the exemplary antenna (100') of FIG. 13. The orientation depicted in FIG. 12 is applied to the radiation pattern plots illustrated in FIGS. 15–16. More specifically, FIG. 15 graphically illustrates the azimuth plane radiation patterns for $\theta=90°$ in the 2.4 GHz band at frequencies of 2.40, 2.45 and 2.50 GHz. As shown, there are no major nulls in the patterns. In addition, the radiation patterns coincide through the frequency band, indicating the antenna bandwidth is very wide for the application. FIG. 15 depicts typical radiation patterns of an inverted-F antenna, which indicates that the exemplary multiband antenna structure (100') behaves as an inverted-F antenna at the lower frequency band.

Furthermore, FIG. 16 graphically illustrates the computed azimuth plane radiation patterns for $\theta=90°$ in the 5 GHz band at frequencies of 5.15, 5.50, and 5.85 GHz. As shown, there are no major nulls in the simulated radiation patterns and the simulated radiation patterns do not change much through the frequency band.

Figure 17:
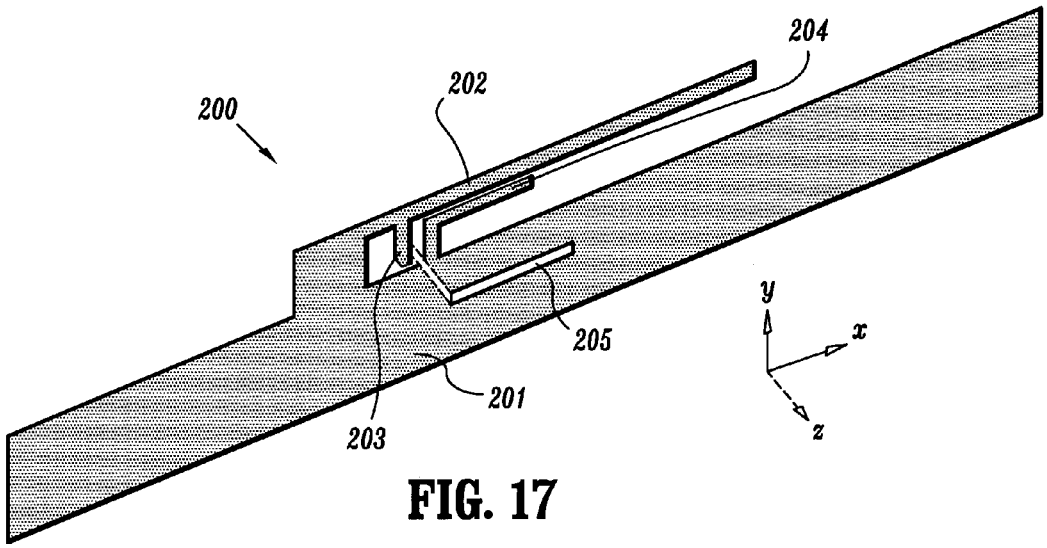
FIG. 17 schematically illustrates a perspective view of a multiband antenna according to another exemplary embodiment of the invention.

FIG. 17 schematically illustrates a perspective view of a multiband antenna (200) according to another exemplary embodiment of the invention. More specifically, FIG. 17 illustrates an INF multiband antenna (200) according to another embodiment of the invention in which the antenna elements are formed from sheet metal. The INF multiband antenna (200) comprises a ground element (201), an outer INF element (202) connected to ground (201) and having a feed tab (203) extending therefrom, a coupled (INL) element (204) connected to ground (201), and a branch element (205) that is connected to the feed element (203). The depicted antenna orientation in FIG. 17 shows the elements of the antenna (200) are planar (x-y plane) but that the branch element (205) is positioned (in x-z plane) substantially perpendicular to the plane (x-y) of the antenna (200). The antenna (200) is fed by, e.g., a coaxial cable, wherein a center conductor is electrically connected to feed element (203) via a solder connection and wherein the outer conductor (ground) of the coaxial cable is electrically connected to the ground element (201) via a solder connection.

FIG. 17 depicts one exemplary embodiment of a multiband antenna (200) that can be formed from stamped sheet metal, wherein the antenna elements and grounding strip are stamped from a planar sheet of metal and wherein the branch element (205) can be subsequently connected (soldered) to the feed element (203).

Figure 18:
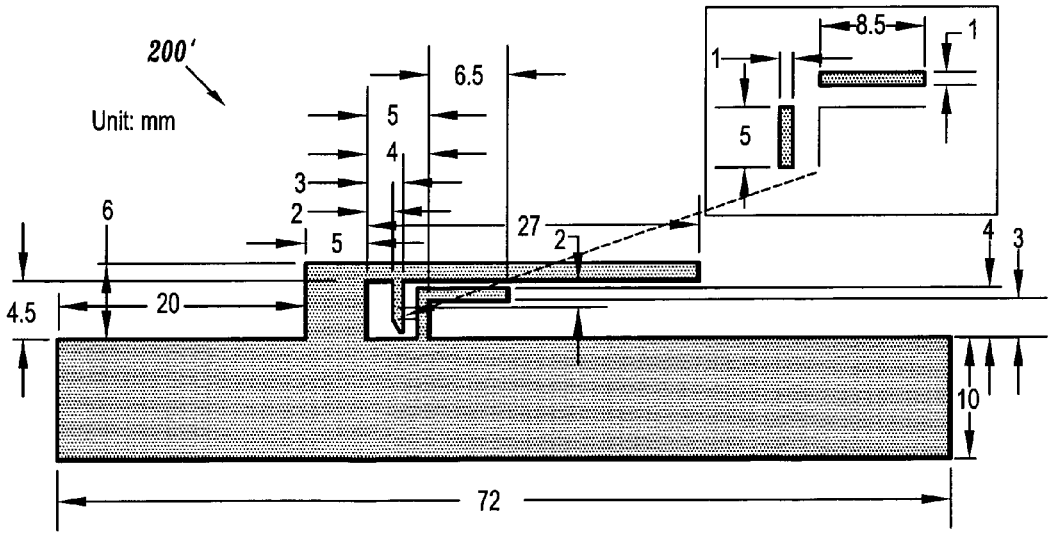
FIG. 18 schematically illustrates a multiband antenna according to another exemplary embodiment of the invention showing exemplary dimensions of the antenna embodiment of FIG. 17 to provide multiband operation in the 2.4 and 5 GHz bands.

FIG. 18 schematically illustrates a perspective view of a multiband antenna (200') according to another exemplary embodiment of the invention. More specifically, FIG. 18 depicts structural dimensions (in millimeters) for the exemplary multiband antenna (200') of FIG. 17 for multiband operation in a first (low) frequency band (e.g., 2.4 GHz–2.5 GHz), and a second (high) frequency band (e.g., 5.15 GHz–5.85 GHz).

Figure 19:
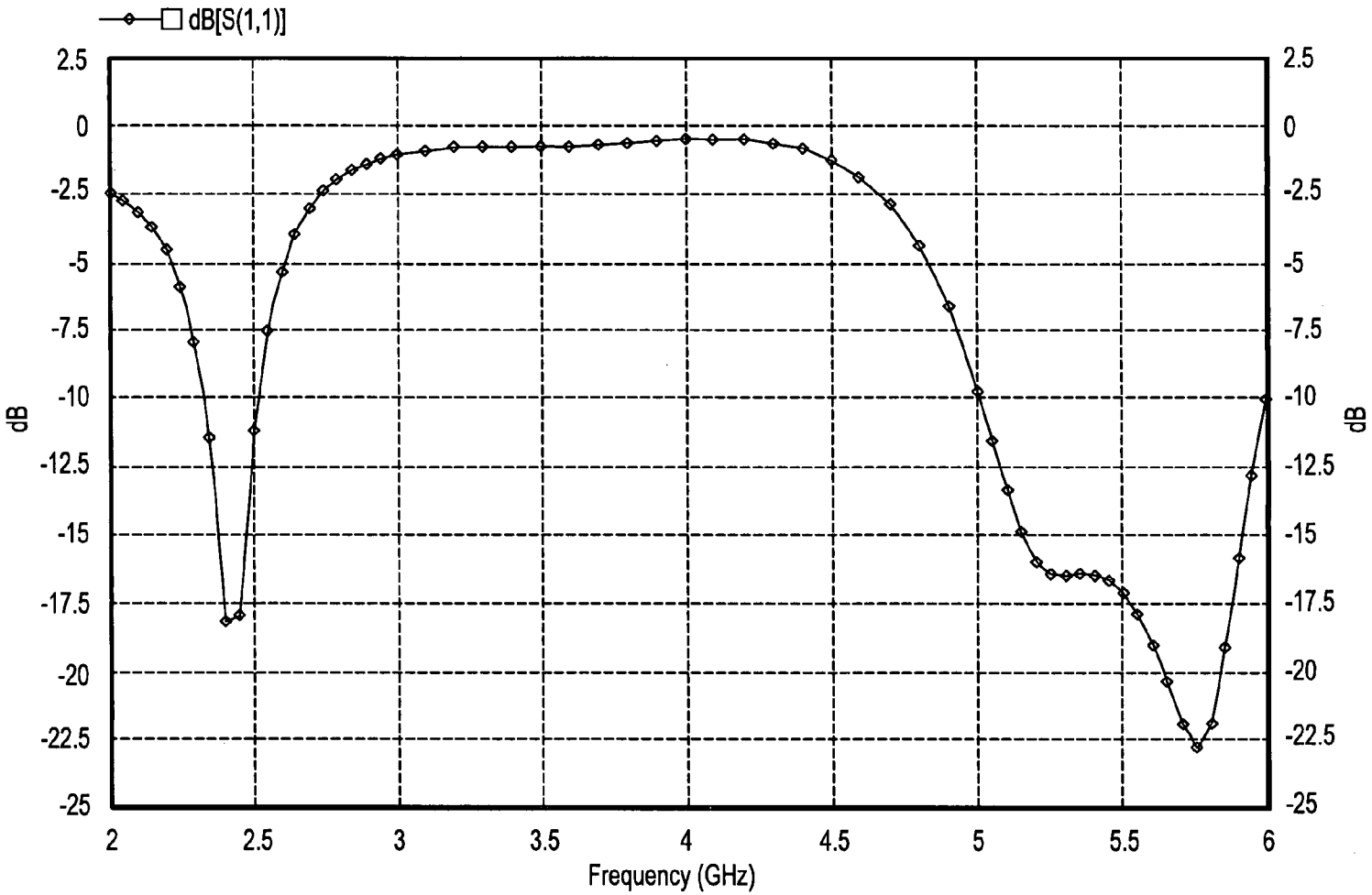
FIG. 19 is a graphical illustration of return loss that was computed based on a computer simulation of the exemplary antenna of FIG. 18.
Figure 20:
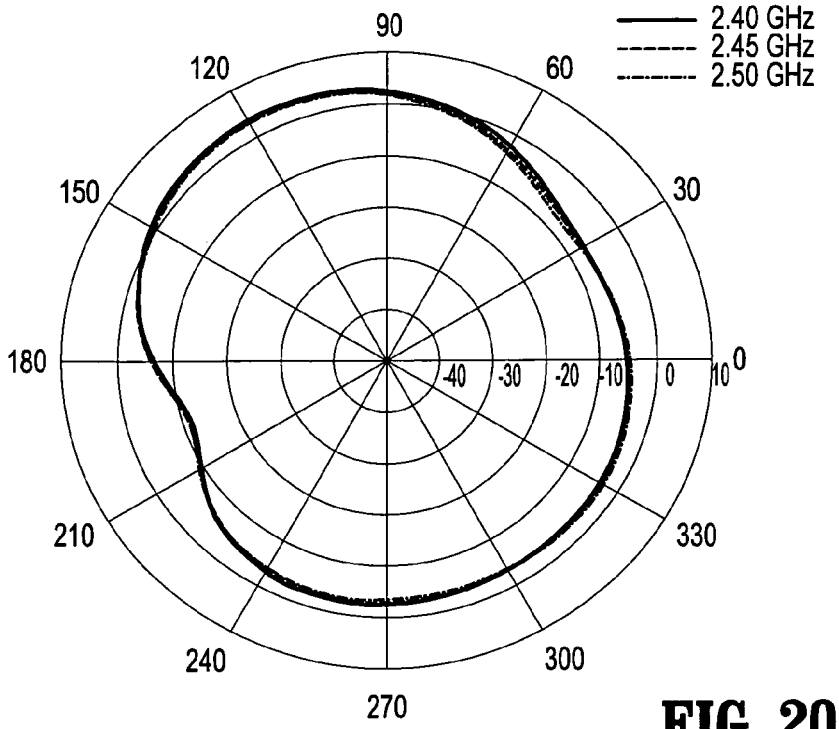
FIG. 20 is a graphical illustration of azimuth plane radiation patterns for $\theta=90°$ in the 2.4 GHz band at frequencies of 2.40, 2.45 and 2.50 GHz, based on the computer simulation of the exemplary antenna of FIG. 18.
Figure 21:
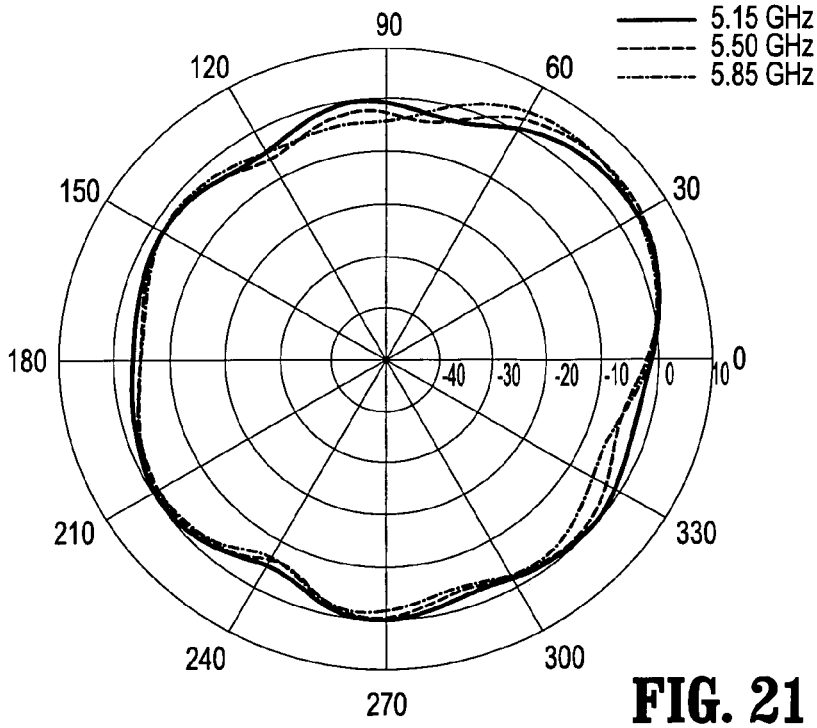
FIG. 21 is a graphical illustration of azimuth plane radiation patterns for $\theta=90°$ in the 5 GHz band at frequencies of 5.15, 5.50 and 5.85 GHz, based on the computer simulation of the exemplary antenna of FIG. 18.

FIGS. 19–21 are computer generated results that were obtained from computer simulations of an antenna model based on the antenna (200') framework (i.e., the framework and dimensions as depicted in FIGS. 17 and 18), which illustrate simulated return loss and radiation patterns for the antenna (200'). More specifically, FIG. 19 graphically illustrates the results of the simulated return loss of the multiband antenna (200') of FIG. 18. FIG. 19 illustrates the simulated return loss for antenna (200') from 2~6 GHz in which three resonances are shown, where one resonance is used for the 2.4 GHz to 2.5 GHz band, and wherein two resonances are used for the 5 GHz band from 5.15 GHz to 5.85 GHz.

FIGS. 20–21 are graphical diagrams illustrating the simulated radiation patterns at different frequencies for the antenna model based on the exemplary antenna (200') of FIG. 18. The antenna orientation depicted in FIG. 18 is applied to the radiation pattern plots illustrated in FIGS. 20–21. More specifically, FIG. 20 graphically illustrates the azimuth plane radiation patterns for $\theta=90°$ in the 2.4 GHz band at frequencies of 2.40, 2.45 and 2.50 GHz. As shown, there are no major nulls in the patterns. In addition, the radiation patterns coincide through the frequency band, indicating the antenna bandwidth is very wide for the application. FIG. 20 depicts typical radiation patterns of an inverted-F antenna, which indicates that the exemplary multiband antenna structure (200') behaves as an inverted-F antenna at the lower frequency band.

Furthermore, FIG. 21 graphically illustrates the computed azimuth plane radiation patterns for $\theta=90°$ in the 5 GHz band at frequencies of 5.15, 5.50, and 5.85 GHz. As shown, there are no major nulls in the simulated radiation patterns and the simulated radiation patterns do not change much through the frequency band.

It is to be understood that the exemplary embodiment described herein are merely exemplary, and that other multiband antenna structures can be readily envisioned by one of ordinary skill in the art based on the teachings herein. For instance, although FIGS. 7A~7I, 13 and 17, for example, depict the INF element and coupled element being in the same plane, these elements may be offset. For example, the coupled element can be disposed on one side of the INF element and the branch element can be disposed on the other side of the INF element. Moreover, as noted above, a multiband antenna may have no coupled element, but comprise an INF element having one or more branch elements connected the INF element and/or a feed tab of the INF element. Moreover, a multiband antenna may have one or more coupled elements, and an INF element having one or more branch elements connected the INF element and/or a feed tab of the INF element.

Furthermore, the exemplary multiband antenna described herein may be implemented using multi-layered PCBS. For instance, a PCB comprising a planar substrate with thin metallic layers on opposite sides of the substrate can be used for constructing a multiband antenna according to the invention. In particular, by way of example, an INF and coupled element can be patterned on one side of the PCB substrate, and a branch element can be patterned on the other side of the PCB substrate, wherein a connecting via can be formed through the substrate to connect the INF and branch elements. With PCB implementations, the exemplary antenna dimensions and tuning parameters would be modified to account for the dielectric constant of the substrate.

Although illustrative embodiments have been described herein with reference to the accompanying drawings, it is to be understood that the present invention is not limited to those precise embodiments, and that various other changes and modifications may be affected therein by one skilled in the art without departing from the scope of the invention.

What is claimed is:

1. A multiband antenna, comprising:

a dipole radiator;

a coupled radiator, wherein the coupled radiator is capacitively fed; and a branch radiator connected to the dipole radiator.

2. The multiband antenna of claim 1, wherein the dipole radiator is fed with balanced feed line.

3. The multiband antenna of claim 1, wherein the multiband antenna provides dual-band operation.

4. The multiband antenna of claim 3, wherein the dipole radiator has a resonant frequency in a first frequency band of operation, and wherein the coupled and branch radiator have resonant frequencies in a second frequency band of operation.

5. The multiband antenna of claim 1, wherein the multiband antenna provides tri-band operation.

6. The multiband antenna of claim 5, wherein the dipole radiator has a first resonant frequency in a first frequency band of operation, wherein the coupled radiator has a second resonant frequency in a second frequency band of operation, and wherein the branch radiator has a third resonant frequency in a third band of operation.

7. The multiband antenna of claim 1, wherein the multiband dipole antenna provides multiband operation for the 2.4 GHz and 5 GHz bands.

8. A wireless device having the multiband antenna of claim 1 integrally formed therein for wireless communication.

9. A portable computer having the multiband antenna of claim 1 integrally formed on a display unit of the portable computer.

10. A multiband antenna, comprising:

a monopole radiator;

a coupled radiator; and a branch radiator connected to the monopole radiator, wherein the multiband antenna provides dual-band operation, wherein the monopole radiator has a resonant frequency in a first frequency band of operation, and wherein the coupled and branch radiator have resonant frequencies in a second frequency band of operation.

11. The multiband antenna of claim 10, wherein multiband antenna is fed with a single feed connected to the monopole radiator.

12. The multiband antenna of claim 10, wherein the multiband antenna provides multiband operation for the 2.4 GHz and 5 GHz bands.

13. The multiband antenna of claim 10, wherein the monopole and coupled radiators are grounded.

14. The multiband antenna of claim 10, wherein the coupled radiator is grounded.

15. A wireless device having the multiband antenna of claim 10 integrally formed therein for wireless communication.

16. A portable computer having the multiband antenna of claim 10 integrally formed on a display unit of the portable computer.

17. A multiband antenna, comprising:

a monopole radiator;

a coupled radiator; and a branch radiator connected to the monopole radiator, wherein the multiband antenna provides tri-band operation, wherein the monopole radiator has a first resonant frequency in a first frequency band of operation, wherein the coupled radiator has a second resonant frequency in a second frequency band of operation, and wherein the branch radiator has a third resonant frequency in a third band of operation.

18. A multiband antenna, comprising:

an inverted-F radiator;

a coupled radiator; and a branch radiator connected to the inverted-F radiator; and a planar ground element, wherein the inverted-F radiator, coupled radiator, branch radiator and planar ground element are patterned from a metallic sheet to form an integrated structure, wherein at least the inverted-F radiator, the coupled radiator or the branch radiator is coplanar with the planar ground element.

19. The multiband antenna of claim 18, wherein multiband antenna is fed with a single feed connected to the inverted-F radiator.

20. The multiband antenna of claim 18, wherein the multiband antenna provides dual-band operation.

21. The multiband antenna of claim 20, wherein the inverted-F radiator has a resonant frequency in a first frequency band of operation, and wherein the coupled and branch radiator have resonant frequencies in a second frequency band of operation.

22. The multiband antenna of claim 18, wherein the multiband antenna provides tri-band operation.

23. The multiband antenna of claim 22, wherein the inverted-F radiator has a first resonant frequency in a first frequency band of operation, wherein the coupled radiator has a second resonant frequency in a second frequency band of operation, and wherein the branch radiator has a third resonant frequency in a third band of operation.

24. The multiband antenna of claim 18, wherein the multiband antenna provides multiband operation for the 2.4 GHz and 5 GHz bands.

25. The multiband antenna of claim 18, wherein the inverted-F radiator and coupled radiator are orientated parallel to each other.

26. The multiband antenna of claim 25, wherein the inverted-F and coupled radiators are orientated parallel to each other in a same plane.

27. The multiband antenna of claim 18, wherein the coupled radiator is an inverted-L radiator.

28. The multiband antenna of claim 18, wherein the inverted-F and coupled radiators are grounded.

29. A wireless device having the multiband antenna of claim 18 integrally formed therein for wireless communication.

30. A portable computer having the multiband antenna of claim 18 integrally formed on a display unit of the portable computer.

31. A multiband antenna, comprising:

an inverted-F radiator;

a coupled radiator; and a branch radiator connected to the inverted-F radiator, wherein the branch radiator is connected to the inverted-F radiator at a feed tab of the inverted-F radiator.

32. A multiband antenna, comprising:

a monopole radiator;

at least one branch radiator connected to the monopole radiator; and a planar ground element, wherein at least the monopole radiator and the planar ground element are patterned from a metallic sheet to form an integrated structure, wherein at least the monopole radiator or the branch radiator is coplanar with the planar ground element.

33. The multiband antenna of claim 32, wherein the monopole radiator is an inverted-F radiator.

34. The multiband antenna of claim 33, wherein the inverted-F radiator is coplanar with the planar ground element.

35. The multiband antenna of claim 34, wherein the inverted-F radiator comprises a feed tab, and wherein the at least one branch radiator is attached to the inverted-F radiator at a point on the feed tab.

36. The multiband antenna of claim 35, further comprising a second branch radiator connected to the inverted-F radiator.

37. The multiband antenna of claim 32, further comprising one or more coupled radiators.

* * * * *